US005517081A

United States Patent [19]

Mitani et al.

[11] Patent Number: 5,517,081

[45] Date of Patent: May 14, 1996

[54] GAS-FILLED DISCHARGE TUBE

[75] Inventors: Tetsuya Mitani; Hiromitsu Tsuchiya, both of Shizuoka, Japan

[73] Assignee: Yazaki Corporation, Tokyo, Japan

[21] Appl. No.: 305,986

[22] Filed: Sep. 19, 1994

[30] Foreign Application Priority Data

Sep. 20, 1993 [JP] Japan ..... 5-233404

[51] Int. Cl.[6] ..... H01J 17/04; H01T 14/00

[52] U.S. Cl. ..... 313/589; 313/631; 313/634; 337/28; 361/120; 123/143 R

[58] Field of Search ..... 313/589, 585, 313/592, 595, 597, 600, 603, 631, 634, 231.41, 234, 356; 337/18, 28; 361/117, 120; 123/143 R

[56] References Cited

U.S. PATENT DOCUMENTS

| | | | |
|---|---|---|---|
| 3,317,777 | 5/1967 | Algar et al. | 313/602 |
| 5,080,083 | 1/1992 | Sato et al. | 313/124 X |
| 5,185,556 | 2/1993 | Yagi et al. | 313/631 X |
| 5,352,953 | 10/1994 | Wakabayashi et al. | 313/631 |

FOREIGN PATENT DOCUMENTS

| | | | |
|---|---|---|---|
| 1394234 | 2/1965 | France | 313/602 |
| 3-24290 | 3/1991 | Japan . | |
| 3-141574 | 6/1991 | Japan . | |
| 5-7032 | 1/1993 | Japan . | |

*Primary Examiner*—Sandra L. O'Shea
*Assistant Examiner*—Ashok Patel
*Attorney, Agent, or Firm*—Wigman, Cohen, Leitner & Myers

[57] ABSTRACT

A gas-filled discharge tube includes a cylindrical casing (11, 31), a terminal member (12, 13; 32, 33) for closing an open end of the casing, an inert gas sealed within the casing, a gas sealing tube (16, 38) connected to an outside of the terminal member, and gas introduction paths (17, 40) formed in the terminal member so as to communicate between an inner space of the gas sealing tube and an inner space of the casing.

10 Claims, 4 Drawing Sheets

GAS-FILLED DISCHARGE TUBE

BACKGROUND OF THE INVENTION

1. Technical Field

The present invention relates to a gas-filled discharge tube, and more specifically to a gas-filled discharge tube used to control voltage in a gap switch for activating a laser apparatus, a sharpener gap switch, an arrester, etc.

2. Description of the Related Art

A discharge tube is used as a gap switch for activating a laser apparatus, a sharpener gap switch, an arrester, etc. As the discharge tube as described above, a discharge tube filled with an inert gas is well known, in which two discharge electrodes are arranged so as to be opposed to each other within and on both sides of an insulated cylindrical casing, as shown in FIG. 1. In this conventional gas-filled discharge tube, a cylindrical casing 1 is airtightly sealed by two metal end plates 3A and 3B' each formed integral with a discharge electrode 2A or 2B on both sides of the casing 1. Further, two gas-sealing tubes 4A and 4B are airtightly passed through the metal end plates 3A and 3B and the discharge electrodes 2A and 2B into the casing 1, respectively.

The gas-filled discharge tube as described above with reference to FIG. 1 can be manufactured by evacuating the internal space of the casing 1, introducing an inert gas into the casing 1 through the gas sealing tube 4A, and crushing an end of the gas sealing tube 4A into a flat shape by applying pressure between both the side surfaces of the gas sealing tube 4A (as disclosed in Japanese Published Unexamined (Kokai) Utility Model Application No. 3-24290 or Patent Application Nos. 3-141574 and 5-7032, for instance).

The gas-filled discharge tube is used in various fields, and thereby a small-sized tube is often required according to the use. In the conventional gas-filled discharge tube, however, since the diameter of the gas sealing tube 4A must be reduced with decreasing size of the discharge tube or the casing 1, when the casing 1 is evacuated (before the gas is introduced into the casing 1), the evacuation efficiency is low even if a vacuum pump of high performance is connected to the gas sealing tube 4A. As a result, there exists a problem in that impurities sticking onto the inner surface of the cylindrical casing 1 and the discharge electrodes 2A and 2B cannot be removed sufficiently, so that the discharge characteristics of the manufactured gas-filled discharge tube deteriorate with the passage of time. On the other hand, since it takes relatively a long time to perfectly remove the impurities sticking onto the inner surfaces of the discharge tube, tile productivity is inevitably lowered.

SUMMARY OF THE INVENTION

The object of the present invention is to provide a gas-filled discharge tube of small size, which can improve the evacuation efficiency by keeping the diameter of the gas sealing tube relatively large, for prevention of discharge characteristics from deteriorating with the passage of time.

To achieve the above-mentioned object, the present invention provides a gas-filled discharge tube, comprising: a cylindrical casing; a terminal member for closing an open end of said casing; an inert gas sealed within said casing: a gas sealing tube connected to an outside of said terminal member; and at least one gas introduction path formed in said terminal member so as to communicate between an inner space of said gas sealing tube and an inner space of said casing.

In the gas-filled discharge tube according to the present invention, since the internal space of the gas sealing tube communicates with the internal space of the discharge tube (casing) through a plurality of gas introduction holes, when the discharge tube (casing) is evacuated through the gas sealing tube, it is possible to remove the internal gas efficiently, so that impurities sticking onto the internal surface of the discharge tube can be removed perfectly in a short time, even if the diameter of the discharge tube is sufficiently reduced.

DETAILED DESCRIPTION OF THE EMBODIMENTS

An embodiment of the gas-filled discharge tube according to the present invention will be described in detail with reference to the attached drawings.

Figure 1:
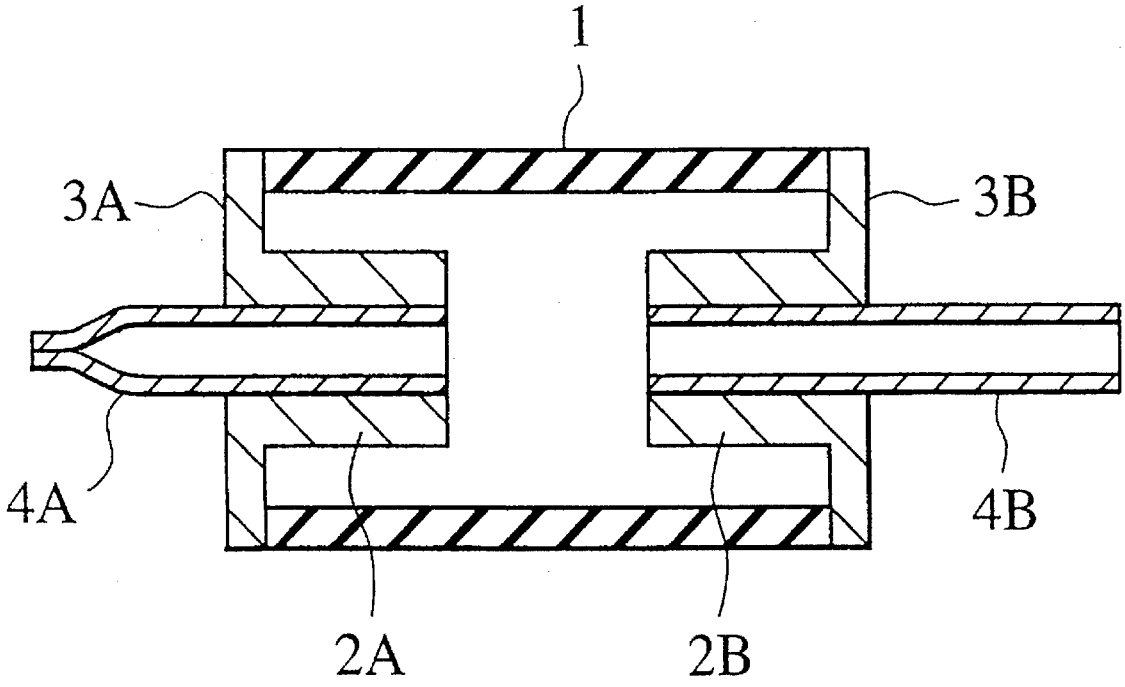
FIG. 1 PRIOR ART
FIG. 1 is a cross-sectional view showing the structure of a conventional gas-filled discharge tube.
Figure 2:
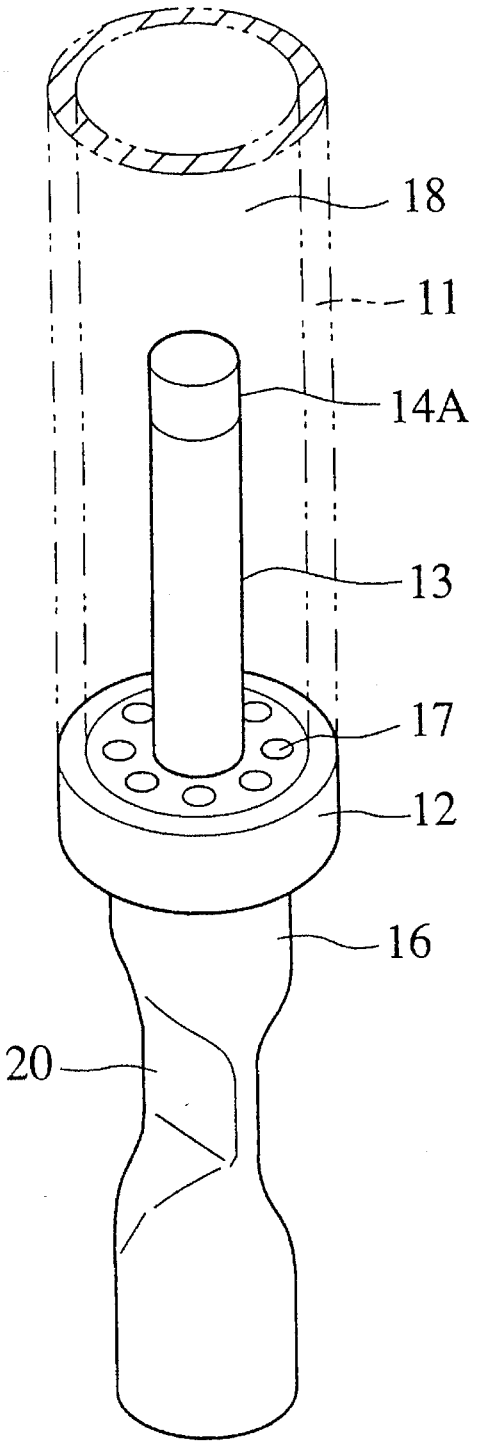
FIG. 2 is a partial perspective view showing the structure of an embodiment of the gas-filled discharge tube according to the present invention.
Figure 3:
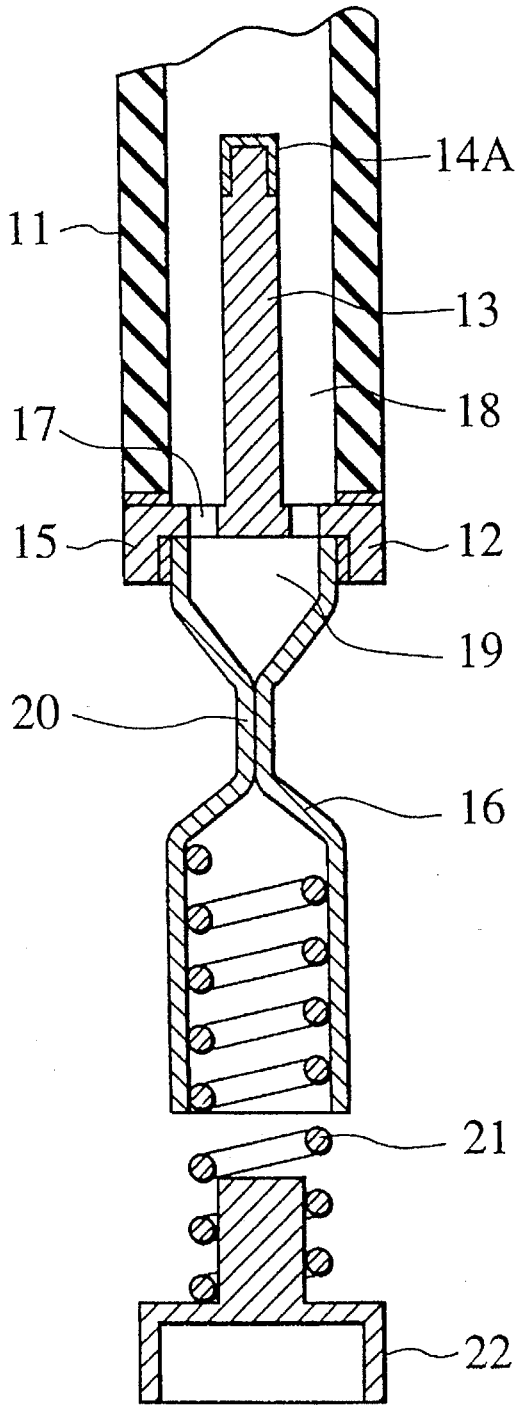
FIG. 3 is a partial cross-sectional view showing a mounted status of the gas-filled discharge tube according to the present invention.

In FIGS. 2 and 3, a cylindrical casing 11 is made of ceramic. An end of the cylindrical casing 11 is closed by a flange-shaped terminal plate 12 by fusing with glass frit or by brazing with a metal solder. The terminal plate 12 is formed with a cylindrical electrode base 13 projecting inward from the central portion of the terminal plate 12, and a cap-shaped discharge electrode 14A is attached to the innermost end of this cylindrical electrode base 13. Further, although not shown, another discharge electrode is attached to an inner end surface of the casing 11 so as to form a pair of discharge electrodes.

Further, the terminal plate 12 is formed integral with a short cylindrical wall 15 along the circumference thereof so as to project outward from the casing 11. The inner circumferential surface of the cylindrical wall 15 and the outer circumferential surface of a gas-sealing tube 16 are airtightly jointed with each other by brazing, for instance. The terminal plate 12 is further formed with gas introduction holes 17 arranged at regular angular intervals along a circumference of the terminal plate 12 and radially outside the electrode base 13. Through these gas introduction holes 17, an internal space 18 of the discharge tube (the casing 11) can communicate with an internal space 19 of the gas-sealing tube 16.

Here, the cylindrical gas-sealing tube 16 is formed with an intermediate flat portion 20 obtained by crushing the middle portion thereof and welding the crushed portion. The upper inner space 19 of the gas-sealing tube 16 serves to fill the gas within the discharge tube, and the lower portion thereof serves as a kind of a terminal pin connected to another discharge tube mounting fixture 22. The terminal pin with a relatively large diameter constructed by crushing the gas-sealing tube as described above has a high rigidity without being deformed easily by an external force. In addition, the terminal pin can be connected elastically and securely to a discharge tube mounting fixture 22 by interposing a coil spring 21 between the two.

Figure 4A:
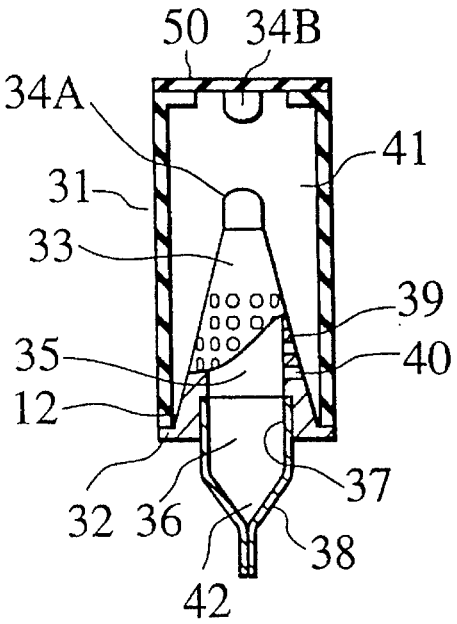
FIGS. 4A to 4D are cross-sectional views showing other structural modifications of the gas-filled discharge tube according to the present invention.

FIGS. 4A to 4D show some modifications of the gas-filled discharge tube of the present invention. In FIG. 4A, an electrode base 33 is formed into a conical shape as the terminal member. In more detail, a cylindrical casing 31 is made of ceramic. A lower end of the cylindrical casing 31 is closed by a flange-shaped terminal member 32 fixed to the lower open end of the casing 31 by fusing with glass frit or by brazing with a metal solder. The flange-shaped terminal member 32 is formed integral with the conical hollow electrode base 33 projecting inward of the casing 31, and a cap-shaped discharge electrode 34A is attached to the innermost end of this electrode base 33. Further, another discharge electrode 34B is attached to an inner surface of an insulated casing lid 50 airtightly fixed to the upper end of the casing 31, so as to form a pair of the discharge electrodes 34A and 34B.

The hollow portion 35 of the conical electrode base 33 is open inward into the casing 31. Further, an inner circumferential surface 37 of the flange-shaped terminal member 32 is airtightly joined with the outer circumferential surface of a gas-sealing tube 38 by brazing, for instance. On the other hand, a side wall 39 enclosing the hollow portion 35 of the conical electrode base 33 is further formed with gas introduction holes 40 arranged at regular intervals in the axial and radial directions of the conical electrode base 33. Through these gas introduction holes 40, an internal space 41 of the discharge tube (casing 31) can communicate with an internal space 42 of the gas-sealing tube 38. In the modification shown in FIG. 4A, the shape of the casing 31 is cylindrical and the shape of the discharge electrode 34A is also short and cylindrical.

Figure 4B:
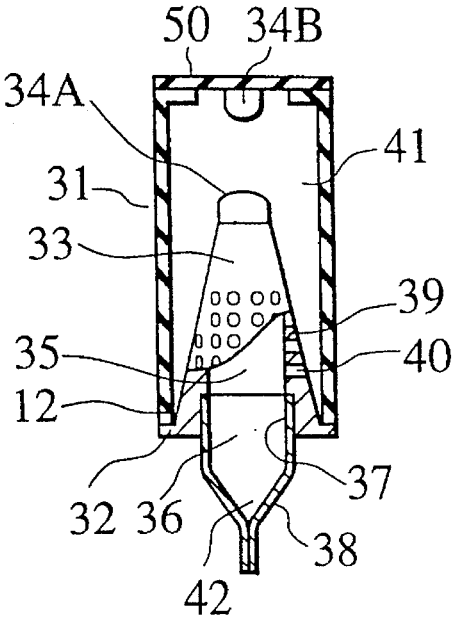
Figure 4C:
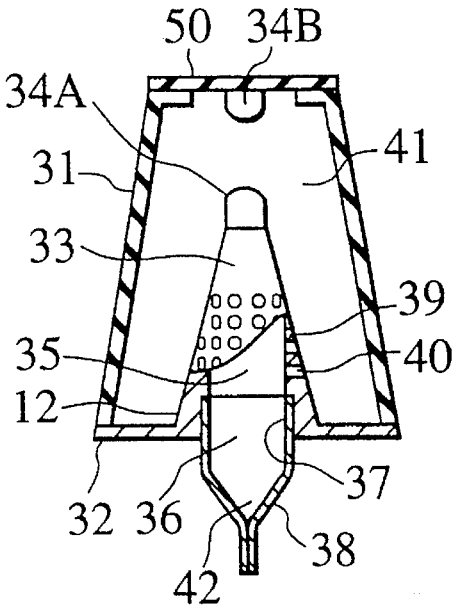
Figure 4D:
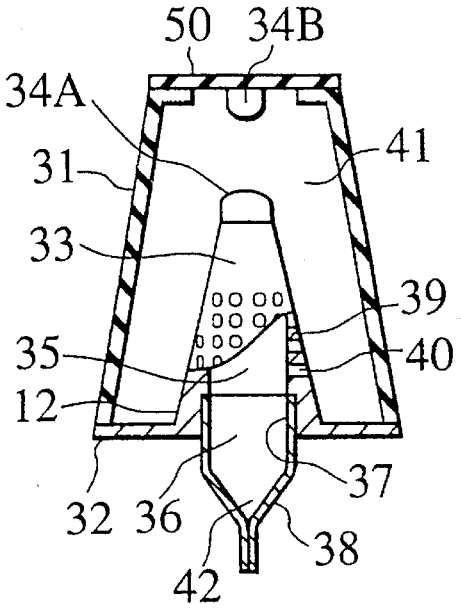

In the modification shown in FIG. 4B, the shape of the casing 31 is also cylindrical but the shape of the discharge electrode 34A is conical. In the modification shown in FIG. 4C, the shape of the casing 31 is conical but the shape of the discharge electrode 34A is cylindrical. In the modification shown in FIG. 4D, the shape of the casing 31 is conical and the shape of the discharge electrode 34A is also conical.

In these modifications shown in FIGS. 4A to 4D, although the shapes of the casing 31 and the discharge electrode 34A are different from each other, since a number of gas introduction holes 40 are formed in the side wall 39 of the conical electrode base 33, it is possible to evacuate the discharge tube at a high efficiency, so that it is possible to prevent the discharge characteristics from deteriorating due to the presence of residual substances within the discharge tube with the passage of time.

In the gas-filled discharge tube according to the present invention, since the gas sealing tube diameter is relatively large in comparison with the casing diameter, since the gas sealing tube is Joined with the end portion of the terminal plate, and since gas within the discharge tube (casing) can be evacuated efficiently through the gas introduction holes formed in the terminal plate, even when the discharge tube size is reduced sufficiently, it is possible to provide a discharge tube of high quality and less deterioration of discharge characteristics. In addition, there exists such another effect that the discharge tube is not deformed easily by an external force and easy to handle.

What is claimed is:

1. A gas-filled discharge tube, comprising:

a cylindrical casing;

a terminal member for closing an open end of said casing;

an inert gas sealed within said casing:

a gas sealing tube connected to an outside of said terminal member; and a plurality of gas introduction paths formed in said terminal member so as to communicate between an inner space of said gas sealing tube and an inner space of said casing;

wherein said terminal member has a terminal plate and said plurality of gas introduction paths is formed and arranged along a circumference of said terminal plate.

2. The gas-filled discharge tube of claim 1, wherein said terminal member has a cylindrical electrode base projecting inward from a center portion of the terminal plate into the inner space of said casing, the gas introduction paths being formed passing through terminal plate and radially outside the cylindrical electrode base.

3. The gas-filled discharge tube of claim 1, wherein said terminal member has a cylindrical hollow electrode base opening outward from said casing, and a flange portion formed at a radially outer end of a bottom of the cylindrical hollow electrode base so as to close an open end of said casing, said gas introduction paths being formed passing through a side wall of the cylindrical hollow electrode base.

4. The gas-filled discharge tube of claim 3, wherein said casing is cylindrical in shape.

5. The gas-filled discharge tube of claim 3, wherein said casing is hollow and conical in shape.

6. The gas-filled discharge tube of claim 3, wherein said cylindrical hollow electrode base is conical in shape.

7. The gas-filled discharge tube of claim 6, further comprising a cylindrical discharge electrode attached to an end of said cylindrical hollow electrode base.

8. The gas-filled discharge tube of claim 6, further comprising a conical discharge electrode attached to an end of said cylindrical hollow electrode base.

9. The gas-filled discharge tube of claim 1, wherein said gas introduction paths are circular communication holes.

10. A gas-filled discharge tube, comprising:

a cylindrical casing;

a terminal for closing an open end of said casing;

an inert gas sealed within said casing:

a gas sealing tube connected to an outside of said terminal member; and a plurality of gas introduction paths formed in said terminal member so as to communicate between an inner space of said gas sealing tube and an inner space of said casing;

wherein said terminal member includes an electrode base and said gas introduction paths comprise a number of holes formed in said electrode base.

* * * * *